US010770022B2

(12) United States Patent
Chen et al.

(10) Patent No.: US 10,770,022 B2
(45) Date of Patent: Sep. 8, 2020

(54) SOURCE DRIVER AND A DISPLAY DRIVER INTEGRATED CIRCUIT

(71) Applicant: SAMSUNG ELECTRONICS CO., LTD., Suwon-si, Gyeonggi-Do (KR)

(72) Inventors: Joway Chen, Zhubei (TW); Chul Ho Choi, Seoul (KR); Dip Wu, Zhubei (TW); Hyeong Tae Kim, Seoul (KR); Yuwen Chiou, Zhubei (TW); Jin Woo Kim, Changwon-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 16/288,166

(22) Filed: Feb. 28, 2019

(65) Prior Publication Data

US 2019/0340994 A1 Nov. 7, 2019

(30) Foreign Application Priority Data

May 4, 2018 (KR) ..... 10-2018-0051617

(51) Int. Cl.

| | |
|---|---|
| ***G09G 3/36*** | (2006.01) |
| *G09G 3/3266* | (2016.01) |
| *G09G 3/3275* | (2016.01) |

(52) U.S. Cl.

CPC ..... *G09G 3/3688* (2013.01); *G09G 3/3614* (2013.01); *G09G 3/3677* (2013.01); *G09G 3/3266* (2013.01); *G09G 3/3275* (2013.01); *G09G 2320/041* (2013.01); *G09G 2330/021* (2013.01)

(58) Field of Classification Search

CPC .. G09G 3/3688; G09G 3/3614; G09G 3/3677; G09G 3/3266; G09G 3/3275; G09G 2320/041; G09G 2320/021

See application file for complete search history.

(56) References Cited

U.S. PATENT DOCUMENTS

| | | | |
|---|---|---|---|
| 6,549,186 | B1 | 4/2003 | Kwon |
| 8,717,338 | B2 | 5/2014 | Son et al. |
| 8,854,561 | B2 | 10/2014 | Liao et al. |
| 9,280,945 | B2 | 3/2016 | Oh et al. |

(Continued)

FOREIGN PATENT DOCUMENTS

| | | |
|---|---|---|
| KR | 10-2017-0062601 | 6/2017 |
| KR | 10-1773609 | 9/2017 |

OTHER PUBLICATIONS

Yang et al., "A Multi-Phase Charge-Sharing Technique without External Capacitor for Low-Power TFT-LCD Column Drivers", Department of Electrical Engineering, National Tsing Hua University, IEEE, 2003, pp. V-365-V-368.

*Primary Examiner* — Wing H Chow

(74) *Attorney, Agent, or Firm* — F. Chau & Associates, LLC

(57) ABSTRACT

A source driver including: a first source line; a second source line; a charge sharing switch which controls a connection between the first source line and the second source line; a first cross charge sharing switch which controls a connection between a first capacitor and the first source line, and a connection between a second capacitor and the second source line; and a second cross charge sharing switch which controls a connection between the first capacitor and the second source line, and a connection between the second capacitor and the first source line.

20 Claims, 10 Drawing Sheets

(56) References Cited

U.S. PATENT DOCUMENTS

| | | | | |
|---|---|---|---|---|
| 9,361,846 | B2 | 6/2016 | Ryu et al. | |
| 2011/0164006 | A1* | 7/2011 | Son | G09G 3/3614 345/204 |
| 2011/0310080 | A1 | 12/2011 | Tonomura | |
| 2014/0320464 | A1* | 10/2014 | Ryu | G09G 3/3688 345/204 |

* cited by examiner

SOURCE DRIVER AND A DISPLAY DRIVER INTEGRATED CIRCUIT

CROSS-REFERENCE TO RELATED APPLICATION

This application claims priority under 35 U.S.C. § 119 to Korean Patent Application No. 10-2018-0051617, filed on May 4, 2018 in the Korean Intellectual Property Office, the disclosure of which is incorporated by reference herein in its entirety.

TECHNICAL FIELD

The present inventive concept relates to a source driver and a display driver integrated circuit.

DESCRIPTION OF THE RELATED ART

A Liquid Crystal Display (LCD) may control the voltage applied to a liquid crystal layer of a pixel to adjust an amount of light passing through the pixel. To prevent deterioration of the liquid crystal layer, the LCD may be driven using an inversion driving technique such as a dot inversion.

Although inversion driving can increase the life expectancy and quality of the LCD, it requires a considerable amount of power. In particular, the fluctuation in a display data signal provided to a source driver increases power consumed by the LCD, as well as heat generated by the LCD. Such an increase in heat may adversely affect the operation of the LCD.

SUMMARY

According to an exemplary embodiment of the present inventive concept, there is provided a source driver including a first source line; a second source line; a charge sharing switch which controls a connection between the first source line and the second source line; a first cross charge sharing switch which controls a connection between a first capacitor and the first source line, and a connection between a second capacitor and the second source line; and a second cross charge sharing switch which controls a connection between the first capacitor and the second source line, and a connection between the second capacitor and the first source line.

According to an exemplary embodiment of the present inventive concept, there is provided a display driver integrated circuit (IC) including a source driver which drives a data line of a display panel; a gate driver which drives a gate line of the display panel; and a controller which controls the source driver and the gate driver, wherein the source driver includes a first capacitor, a second capacitor and a channel buffer, and the channel buffer includes: a first source line; a second source line; a charge sharing switch which controls a connection between the first source line and the second source line; a first cross charge sharing switch which controls a connection between the first capacitor and the first source line, and a connection between the second capacitor and the second source line; and a second cross charge sharing switch which controls a connection between the first capacitor and the second source line, and a connection between the second capacitor and the first source line.

According to an exemplary embodiment of the present inventive concept, there is provided a source driver including a first source line, a second source line, a third source line and a fourth source line; a plurality of charge sharing switches which control connections of the first source line, the second source line, the third source line and the fourth source line to each other; a plurality of first cross charge sharing switches which control connections between a first capacitor, the first source line and the third source line, and connections between a second capacitor, the second source line and the fourth source line; and a plurality of second cross charge sharing switches which control connections between the first capacitor, the second source line and the fourth source line, and connections between the second capacitor, the first source line and the third source line.

According to an exemplary embodiment of the present inventive concept, there is provided a source driver including: a buffer array including a first buffer for buffering a first analog image signal having a first polarity and a second buffer for buffering a second analog image signal having a second polarity; an output switch array including a first output switch which controls a connection between the first buffer and a first source line and a second output switch which controls a connection between the second buffer and a second source line; a charge sharing switch which controls a connection between the first source line and the second source line; and a cross charge sharing switch array including a pair of first cross charge sharing switches and a pair of second cross charge sharing switches, wherein the pair of first cross charge sharing switches control a connection between a first capacitor and the first source line and a connection between a second capacitor and the second source line, and the pair of second cross charge sharing switches control a connection between the first capacitor and the second source line and a connection between the second capacitor and the first source line.

BRIEF DESCRIPTION OF THE DRAWINGS

The above and other features of the present inventive concept will become more apparent by describing in detail exemplary embodiments thereof with reference to the attached drawings, in which.

DETAILED DESCRIPTION OF THE EMBODIMENTS

Figure 1:
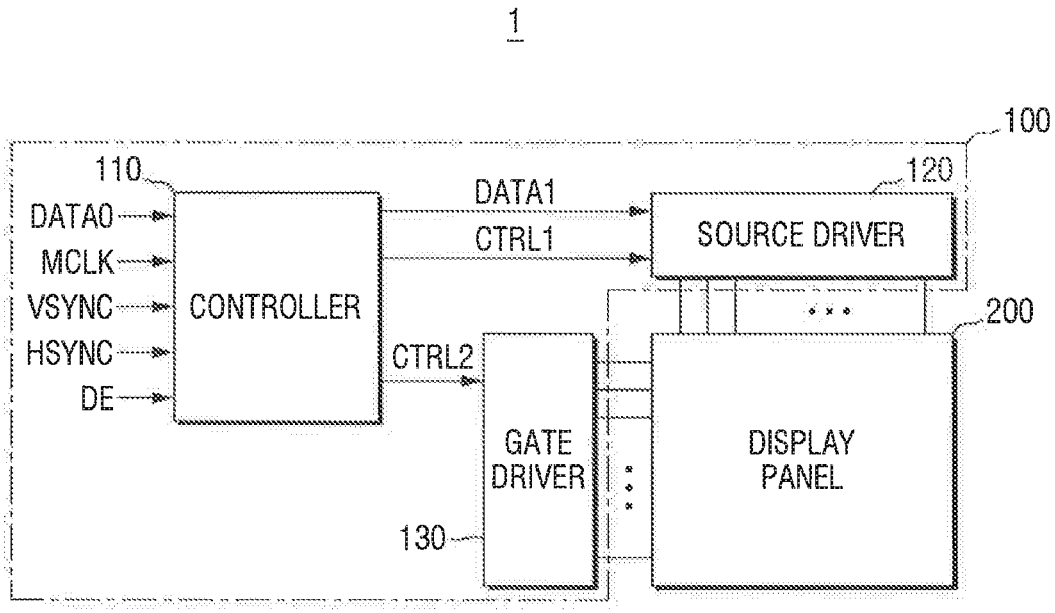
FIG. 1 is a block diagram of a display device according to an exemplary embodiment of the present inventive concept.

FIG. 1 is a block diagram of a display device according to an exemplary embodiment of the present inventive concept.

Referring to FIG. 1, a display device 1 according to an exemplary embodiment of the present inventive concept includes a display driver integrated circuit (IC) 100 and a display panel 200.

The display driver IC 100 is used to drive the display panel 200, and includes a controller 110, a source driver 120 and a gate driver 130.

The display panel 200 includes a plurality of pixels, a plurality of data lines connected to the source driver 120, and a plurality of row lines (or gate lines) connected to the gate driver 130. In other words, the display panel 200 may display an image in accordance with the control of the source driver 120 and the gate driver 130 which will be described later.

In exemplary embodiments of the present inventive concept, the display panel 200 may be a Thin Film Transistor Liquid Crystal Display (TFT LCD), a Light Emitting Diode (LED) display, an Organic LED (OLED) display, an Active Matrix OLED (AMOLED), a flexible display or the like; however, the present inventive concept is not limited thereto. In addition, in exemplary embodiments of the present inventive concept, the display panel 200 may operate in an inversion driving technique such as dot inversion.

The controller 110 receives the input of original image data DATA0, a master clock signal MCLK, a vertical synchronization signal VSYNC, a horizontal synchronization signal HSYNC, a data enable signal DE and the like, and generates signals to operate the source driver 120 and the gate driver 130 in response to the input. Here, the original image data DATA0 represents image data photographed through an arbitrary device outside the display driver IC 100.

The controller 110 may provide a control signal CTRL1 and image data DATA1 to operate the source driver 120 to the source driver 120. Further, the controller 110 may provide a control signal CTRL2 to operate the gate driver 130 to the gate driver 130.

The source driver 120 provides the image data DATA1, which is provided from the controller 110, to the display panel 200. Here, the image data DATA1 may include, for example, RGB format data, YUV format data, and the like; however, and the present inventive concept is not limited thereto.

The source driver 120 receives image data DATA1 including a plurality of bits, such as <D1:DN>, and generates an analog image signal which can be processed by a plurality of buffers (e.g., buffer array 1242 of FIG. 3) included in a channel buffer 124. Then, the channel buffer 124 buffers the analog image signal and provides the buffered analog image signal to the display panel 200.

The gate driver 130 drives a plurality of row lines of the display panel 200.

In exemplary embodiments of the present inventive concept, the display device 1 may further include a power supply. The power supply may provide an operating voltage to the controller 110, the source driver 120, the gate driver 130 and the like, and may also provide a common voltage Vcom to the display panel 200.

Figure 2:
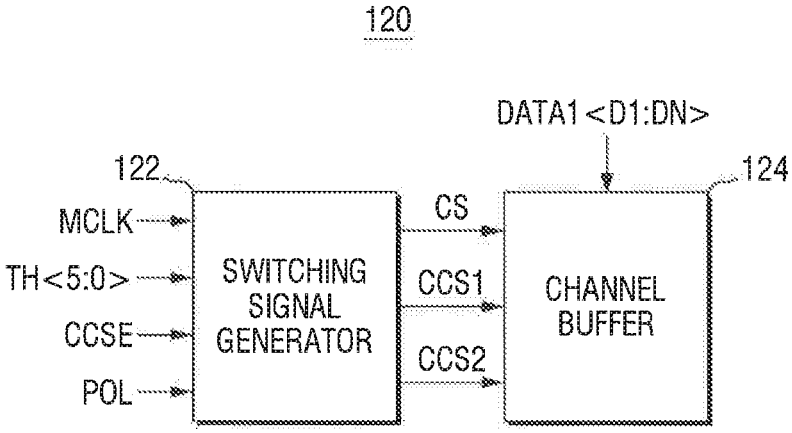
FIG. 2 is a block diagram of a source driver according to an exemplary embodiment of the present inventive concept.

FIG. 2 is a block diagram of a source driver according to an exemplary embodiment of the present inventive concept.

Referring to FIG. 2, the source driver 120 according to an exemplary embodiment of the present inventive concept includes a switching signal generator 122 and a channel buffer 124.

The switching signal generator 122 receives the input of the master clock signal MCLK, a cross charge sharing enable signal CCSE, a polarity signal POL and a horizontal synchronization period signal TH. In response to the input, the switching signal generator 122 generates a charge sharing switch control signal CS, a first cross charge sharing switch control signal CCS1, and a second cross charge sharing switch control signal CCS2. Further, the switching signal generator 122 provides the charge sharing switch control signal CS, the first cross charge sharing switch control signal CCS1, and the second cross charge sharing switch control signal CCS2 to the channel buffer 124.

Here, the cross charge sharing enable signal CCSE is a control signal for determining whether the source driver 120 uses a cross charge sharing technique to be described later. In this embodiment, the cross charge sharing enable signal CCSE may include a plurality of bits such as <5:0>; however, the present inventive concept is not limited thereto.

In addition, the charge sharing switch control signal CS is a control signal for controlling the operation of a charge sharing switch SW_CS which will be described later. Furthermore, the first cross charge sharing switch control signal CCS1 and the second cross charge sharing switch control signal CCS2 correspond to control signals for controlling operations of a first cross charge sharing switch SW_CCS1 and a second cross charge sharing switch SW_CCS2 which will be described later.

In this embodiment, the switching signal generator 122 may be implemented inside the source driver 120 together with the channel buffer 124.

Figure 3:
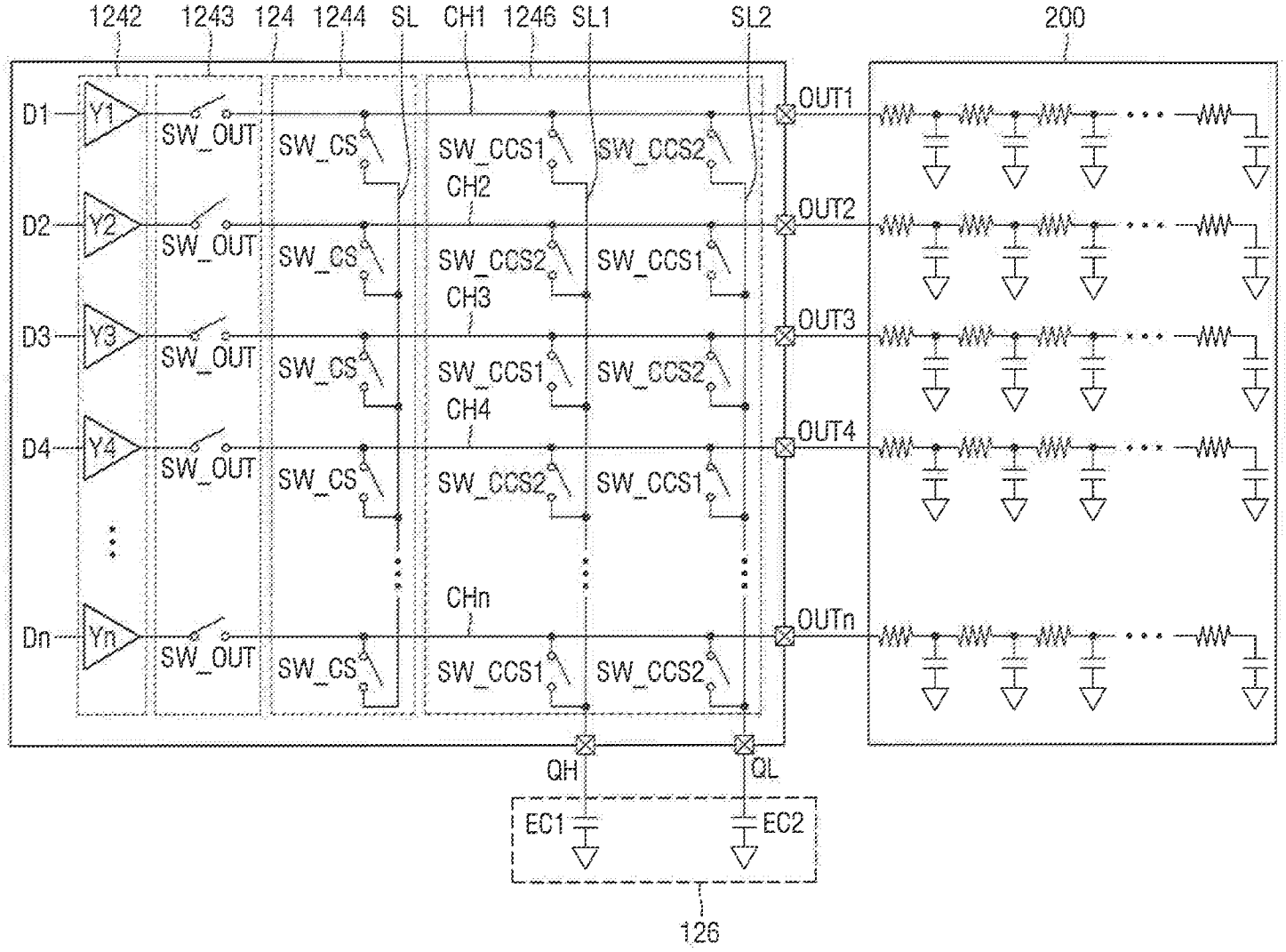
FIG. 3 is a diagram of a source driver and a display panel according to an exemplary embodiment of the present inventive concept.

FIG. 3 is a diagram of a source driver and a display panel according to an exemplary embodiment of the present inventive concept.

Referring to FIG. 3, the source driver 120 according to an exemplary embodiment of the present inventive concept includes a channel buffer 124 and an external capacitor 126. Here, the channel buffer 124 is connected to the display panel 200 through a plurality of output terminals (OUT1 to OUTn), and is connected to the external capacitor 126 through the terminals (QH and QL).

The channel buffer 124 includes a buffer array 1242, an output switch array 1243, a charge sharing switch array 1244 and a cross charge sharing switch array 1246.

The buffer array 1242 includes a plurality of buffers (Y1, Y2, . . . , Yn) for buffering the analog image signals (D1 to Dn) generated from the image data DATA1, respectively.

In this embodiment, the odd-numbered buffers (Y1, Y3, . . . ) among the plurality of buffers (Y1, Y2, . . . , Yn) may buffer the image signals (D1, D3, . . . ) having a first polarity, for example, a positive polarity. For example, the even-numbered buffers (Y2, Y4, . . . ) among the plurality of buffers (Y1, Y2, . . . , Yn) may buffer the image signals (D2, D4, . . . ) having a second polarity, for example, a negative polarity. Here, the first polarity may correspond to, for example, a voltage higher than the common voltage Vcom, and the second polarity may correspond to, for example, a voltage lower than the common voltage Vcom.

The output switch array 1243 includes a plurality of output switches SW_OUT which control connections between the buffers (Y1, Y2, . . . , Yn) of the buffer array 1242 and source lines (CH1, CH2, . . . , CHn). In other words, when the output switches SW_OUT are turned on, a connection is formed between the buffers (Y1, Y2, . . . , Yn) and the source lines (CH1, CH2, . . . , CHn), and when the output switches SW_OUT are turned off, the buffers (Y1, Y2, . . . , Yn) and the source lines (CH1, CH2, . . . , CHn) are disconnected from each other.

The charge sharing switch array 1244 includes a plurality of charge sharing switches SW_CS which control the connections between the odd-numbered source lines (CH1, CH3, . . . ) and even-numbered source lines (CH2, CH4, . . . ) among the plurality of source lines (CH1, CH2, . . . , CHn). In other words, when the plurality of charge sharing switches SW_CS are turned on, the connection between the odd-numbered source lines (CH1, CH3, . . . ) and the even-numbered source lines (CH2, CH4, . . . ) is formed, and when the plurality of charge sharing switches SW_CS are turned off, the odd-numbered source lines (CH1, CH3, . . . ) and the even-numbered source lines (CH2, CH4, . . . ) are disconnected from each other.

In other words, if only the first source line CH1 and the second source line CH2 are considered, a single charge sharing switch SW_CS may control the connection of the first source line CH1 and the second source line CH2.

If the first source line CH1 to the fourth source line CH4 are considered, the plurality of charge sharing switches SW_CS may control the connection of the first source line CH1 to the fourth source line CH4.

The charge sharing switch array 1244 includes a charge sharing line SL that connects to second ends of the plurality of charge sharing switches SW_CS, wherein each of the plurality of charge sharing switches SW_CS has a first end connected to a respective one of the source lines (CH1, CH2, . . . . CHn).

The cross charge sharing switch array 1246 includes a plurality of first cross charge sharing switches SW_CCS1, and a plurality of second cross charge sharing switches SW_CCS2.

The plurality of first cross charge sharing switches SW_CCS1 control the connection between a first external capacitor EC1 and the odd-numbered source lines (CH1, CH3, . . . ), and control the connection between a second external capacitor EC2 and the even-numbered source lines (CH2, CH4, . . . ). In other words, when the plurality of first cross charge sharing switches SW_CCS1 are turned on, the connection between the first external capacitor EC1 and the odd-numbered source lines (CH1, CH3, . . . ) and the connection between the second external capacitor EC2 and the even-numbered source lines (CH2, CH4, . . . ) are formed. When the plurality of first cross charge sharing switches SW_CCS1 are turned off, the connection between the first external capacitor EC and the odd-numbered source lines (CH1, CH3, . . . ) and the connection between the second external capacitor EC2 and the even-numbered source lines (CH2, CH4, . . . ) is severed.

In other words, when considering only the first source line CH1 and the second source line CH2, two of the first cross charge sharing switches SW_CCS1 control the connection between the first external capacitor EC and the first source line CH1, and the connection between the second external capacitor EC2 and the second source line CH2.

If the first source line CH1 to the fourth source line CH4 are considered, four of the plurality of first cross charge sharing switches SW_CCS1 may control the connection between the first external capacitor EC1 and the first source line CH1, the connection between the second external capacitor EC2 and the second source line CH2, the connection between the first external capacitor EC1 and the third source line CH3, and the connection between the second external capacitor EC2 and the fourth source line CH4.

The plurality of second cross charge sharing switches SW_CCS2 control the connection between the first external capacitor EC1 and the even-numbered source lines (CH2, CH4, . . . ), and control the connection between the second external capacitor EC2 and the odd-numbered source lines (CH1, CH3, . . . ). In other words, when the plurality of first cross charge sharing switches SW_CCS1 are turned on, the connection between the first external capacitor EC1 and the even-numbered source lines (CH2, CH4, . . . ), and the connection between the second external capacitor EC2 and the odd-numbered source lines (CH1, CH3, . . . ) are formed. When the plurality of first cross charge sharing switches SW_CCS1 are turned off, the connection between the first external capacitor EC1 and the even-numbered source lines (CH2, CH4, . . . ), and the connection between the second external capacitor EC2 and the odd-numbered source lines (CH1, CH3, . . . ) is severed.

In other words, when considering only the first source line CH1 and the second source line CH2, two of the second cross charge sharing switches SW_CCS2 control the connection between the first external capacitor EC1 and the second source line CH2, and the connection between the second external capacitor EC2 and the first source line CH1.

When considering the first source line CH1 to the fourth source line CH4, two of the second cross charge sharing switches SW_CCS2 may control the connection between the first external capacitor EC1, the second source line CH2 and the fourth source line CH4, and two of the second cross charge sharing switches SW_CCS2 may control the connection between the second external capacitor EC2, the first source line CH1 and the third source line CH3.

Further, the cross charge sharing switch array 1246 includes a first cross charge sharing line SL1 and a second cross charge sharing line SL2 connected to ends of the plurality of first cross charge sharing switches SW_CCS1 and the plurality of second cross charge sharing switch SW_CCS2. Other ends of the plurality of first cross charge sharing switches SW_CCS1 and the plurality of second cross charge sharing switch SW_CCS2 are connected to the source lines (CH1, CH2, . . . , CHn).

The external capacitor 126 may be implemented to include the first external capacitor EC1 connected to the first cross charge sharing line SL1 through the terminal QH, and the second external capacitor EC2 connected to the second cross charge sharing line SL2 through the terminal QL; however, the configuration or the implementation of the external capacitor 126 is not limited thereto, and may be variously changed.

Figure 4:
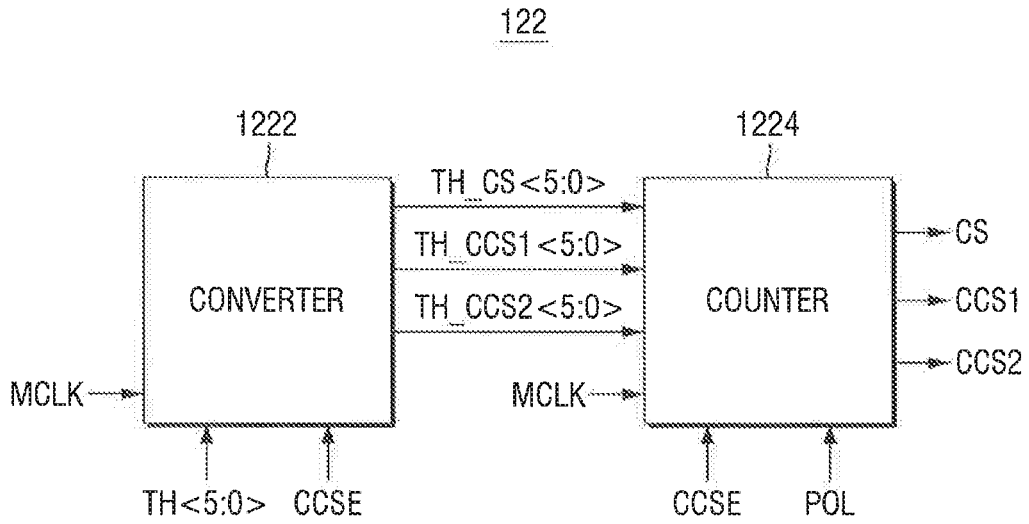
FIG. 4 is a block diagram of a switching signal generation module according to an exemplary embodiment of the present inventive concept.

FIG. 4 is a block diagram of a switching signal generator according to an exemplary embodiment of the present inventive concept.

Referring to FIG. 4, the switching signal generator 122 described above in connection with FIG. 2 may include a converter 1222 and a counter 1224.

The converter 1222 receives the input of a master clock signal MCLK, a cross charge sharing enable signal CCSE, and, for example, a 6-bit horizontal synchronization period signal TH. The converter 1222 may divide the horizontal synchronization period signal TH into a first horizontal synchronization period signal TH_CS, a second horizontal synchronization period signal TH_CCS1 and a third horizontal synchronization period signal TH_CCS2.

The counter 1224 receives the input of the first horizontal synchronization period signal TH_CS, the second horizontal synchronization period signal TH_CCS1 and the third horizontal synchronization period signal TH_CCS2 provided from the converter 1222. The counter 1224 may generate the charge sharing switch control signal CS, the first cross charge sharing switch control signal CCS1, and the second cross charge sharing switch control signal CCS2 in accordance with the polarity signal POL.

In exemplary embodiments of the present inventive concept, the horizontal synchronization period signal TH may classify, for example, 6 bits into three types of parameters, and may transfer the values of these parameters to the counter 1224.

For example, the horizontal synchronization period signal TH may include a first bit, a second bit and a third bit. In this case, the first horizontal synchronization period signal TH_CS may transfer the value to the counter 1224, for example, using the first bit corresponding to the upper 2 bits among 6 bits. Further, the second horizontal synchronization period signal TH_CCS1 may transfer a value to the counter 1224, for example, using a second bit corresponding to the middle 2 bits among 6 bits, and the third horizontal synchronization period signal TH_CCS2 may transfer the value to the counter 1224, for example, using the third bit corresponding to the lower 2 bits among 6 bits.

However, such implementation is merely an example, and thus, the implementation of the switching signal generator 122 of the present inventive concept is not limited thereto, and may be implemented in other ways.

The load of the display panel 200 may be represented by a resistive-capacitive (RC) model as illustrated in FIG. 2. From this, it can be understood that the power consumption generated in the driving operation of the display panel 200 operating in the inversion driving manner, in particular, the source driver 120, is considerably high. Furthermore, the heat generation caused by the switching current of the display panel 200 may adversely affect the performance and life expectancy of the display device 1.

Since the load of the display panel 200 increases as the resolution of the display panel 200 increases and the frame rate increases, the driving current of the source driver 120 may rapidly increase. Hereinafter, various exemplary embodiments of the present inventive concept addressing such matters will be described.

Figure 5:
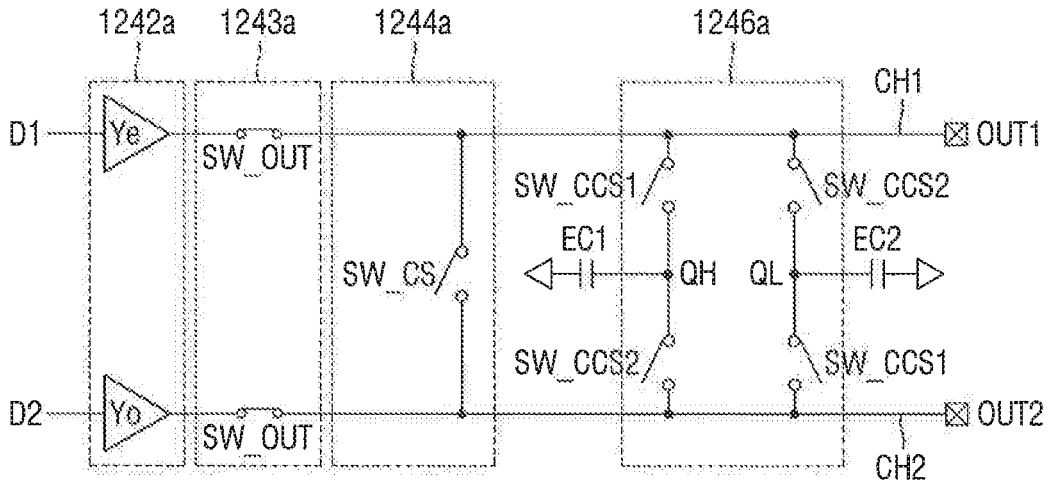
FIG. 5 is a circuit diagram of a source driver according to an exemplary embodiment of the present inventive concept.

FIG. 5 is a circuit diagram of a source driver according to an exemplary embodiment of the present inventive concept. The circuit diagram of FIG. 5 may correspond to a partial circuit of the channel buffer 124 illustrated in FIG. 2.

Referring to FIG. 5, buffer array 1242*a* includes a first buffer Ye and a second buffer Yo for buffering the analog image signals D1 and D2 generated from the image data DATA1. Here, it is assumed that the first buffer Ye buffers the image signal D1 having the positive polarity and the second buffer Yo buffers the image signal D2 having the negative polarity.

Output switch array 1243*a* includes two output switches SW_OUT which control the connection between the first source line CH1 and the first buffer Ye, and the connection between the second source line CH2 and the second buffer Yo, respectively.

The output switch array 1243*a* is turned on before and after the cross charge sharing technique is performed, and the output switch array 1243*a* is turned off while the cross charge sharing technique is performed.

Charge sharing switch array 1244*a* includes a charge sharing switch SW_CS which controls the connection between the first source line CH1 and the second source line CH2.

Cross charge sharing switch array 1246*a* includes two first cross charge sharing switches SW_CCS1 and two second cross charge sharing switches SW_CCS2. The two first cross charge sharing switches SW_CCS1 control the connection between the first external capacitor EC1 and the first source line CH1, and the connection between the second external capacitor EC2 and the second source line CH2. The two second cross charge sharing switches SW_CCS2 control the connection between the first external capacitor EC1 and the second source line CH2, and the connection between the second external capacitor EC2 and the first source line CH1.

The first output terminal OUT1 and the second output terminal OUT2 provide each channel signal after the cross charge sharing technique is executed. In other words, the first and second output terminals OUT1 and OUT2 provide signals of the first source line CH1 and the second source line CH2, to the display panel 200.

The operation of the source driver according to various embodiments of the present inventive concept will be described with reference to some circuits of the buffer 124 of the channel illustrated in FIG. 5, and FIGS. 6 to 9.

Figure 6:
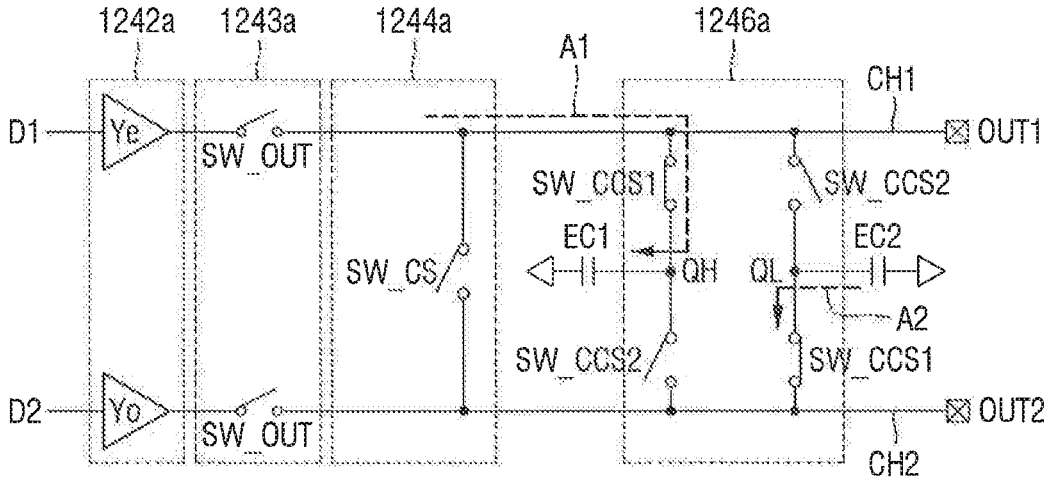
FIGS. 6, 7 and 8 are circuit diagrams illustrating the operation of a source driver according to an exemplary embodiment of the present inventive concept.
Figure 7:
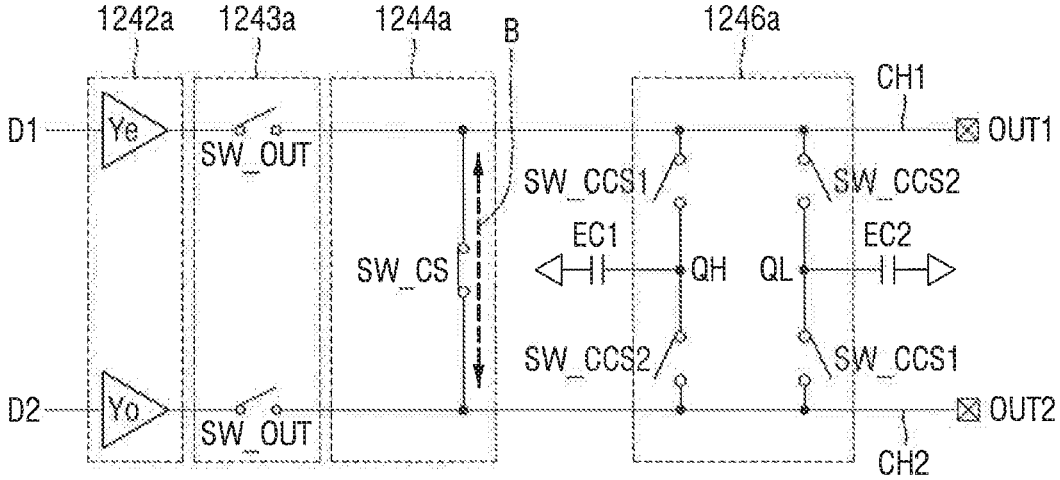
Figure 8:
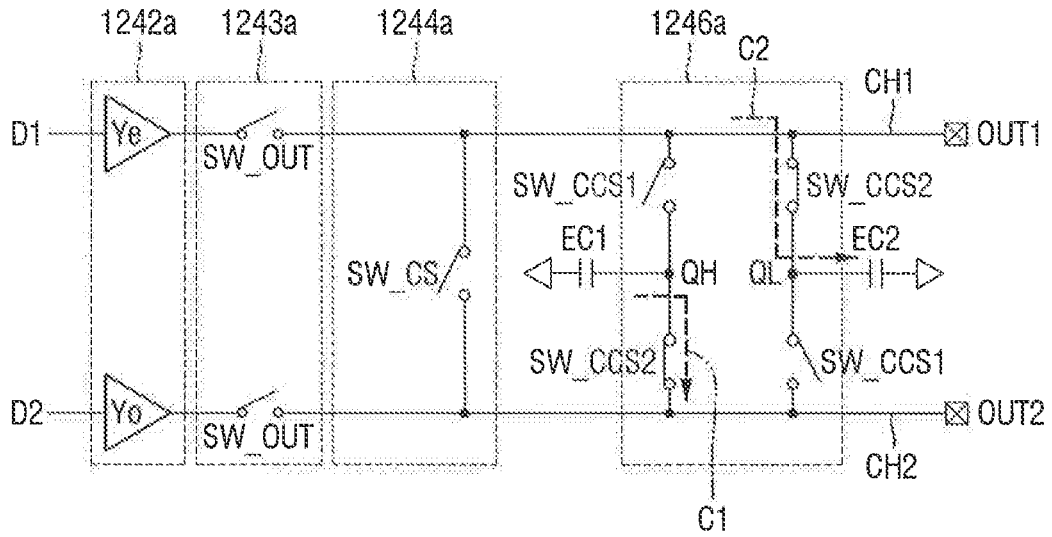
Figure 9:
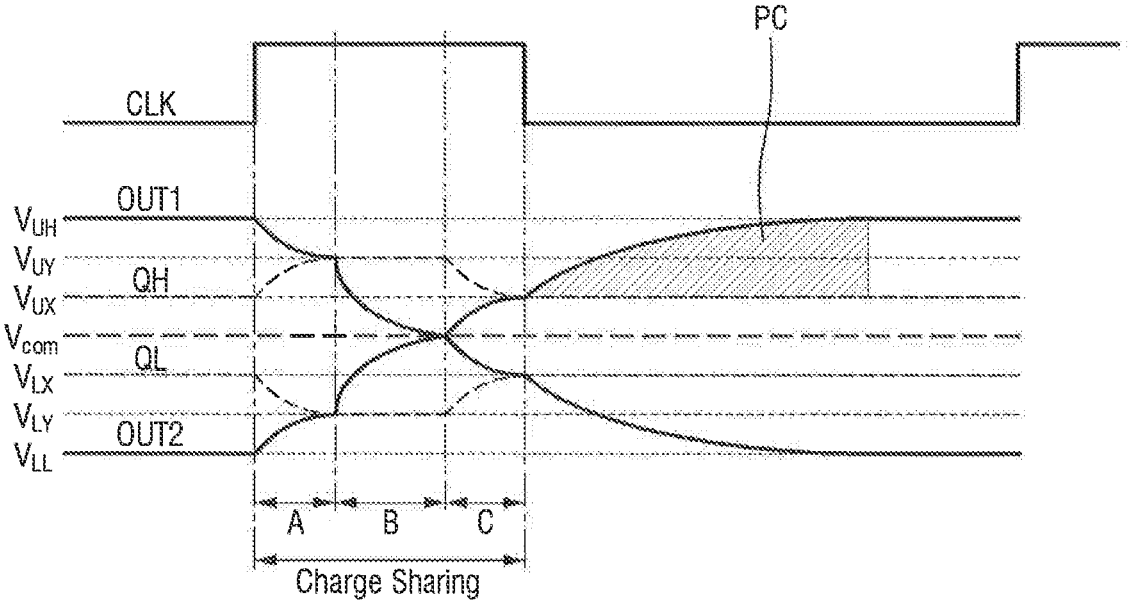
FIG. 9 is a timing chart illustrating the operation of a source driver according to an exemplary embodiment of the present inventive concept.

FIGS. 6 to 8 are circuit diagrams for explaining the operation of a source driver according to an exemplary embodiment of the present inventive concept. Since FIGS. 6 to 8 illustrate a duration of the cross charge sharing technique, the two output switches SW_OUT are turned off. FIG. 9 is a timing chart for explaining the operation of a source driver according to an exemplary embodiment of the present inventive concept.

First, referring to FIG. 6, the first cross charge sharing switch SW_CCS1 is turned on. On the other hand, the charge sharing switch SW_CS and the second cross charge sharing switch CSS2 are turned off.

When the first cross charge sharing switch SW_CCS1 is turned on, a part of the charge of the first source line CH1 is provided to the first external capacitor EC1 (operation A1). Further, the charge stored in the second external capacitor EC2 is provided to the second source line CH2 (operation A2).

Referring to FIG. 9 together FIG. 6, in FIG. 9, the clock signal CLK may be the master clock signal MCLK. However, the clock signal CLK may be another clock signal generated on the basis of the master clock signal MCLK. The section in which the cross charge sharing technique is performed may be divided by the transition of the clock signal CLK.

The above operations A1 and A2 correspond to a section A of FIG. 9. In other words, when the first cross charge sharing switch SW_CCS1 is turned on, and a part of the charge of the first source line CH1 is provided to the first external capacitor EC1, the voltage level of the first output terminal OUT1 decreases from $V_{UH}$ to $V_{UY}$. At this time, the voltage level of the terminal QH increases from $V_{UX}$ to $V_{UY}$ (see the dashed line displayed on the positive channel of FIG. 9).

On the other hand, when the first cross charge sharing switch SW_CCS1 is turned on, and the charge stored in the second external capacitor EC2 is provided to the second source line CH2, the voltage level of the second output terminal OUT2 increases from $V_{LL}$ to $V_{LY}$. At this time, the voltage level of the terminal QL decreases from $V_{LX}$ to $V_{LY}$ (see the dashed line displayed on the negative channel of FIG. 9).

Subsequently, referring to FIG. 7, the charge sharing switch SW_CS is turned on. In addition, the first cross charge sharing switch SW_CCS1 and the second cross charge sharing switch CSS2 are turned off.

When the charge sharing switch SW_CS is turned on, the charges of the first source line CH1 and the second source line CH2 are shared with each other (operation B).

The operation B corresponds to a section B of FIG. 9. In other words, when the charge sharing switch SW_CS is turned on, such that the charge sharing occurs in the first source line CH1 and the second source line CH2, the voltage levels of the first output terminal OUT1 and the second output terminal OUT2 are determined to be the common voltage Vcom. At this time, since the terminals QH and QL are not connected to the first source line CH1 and the second source line CH2, their voltage levels are maintained as they are.

Subsequently, referring to FIG. 8, the second cross charge sharing switch SW_CCS2 is turned on. In addition, the charge sharing switch SW_CS and the first cross charge sharing switch SW_CSS1 are turned off.

When the second cross charge sharing switch SW_CCS2 is turned on, the charge stored in the first external capacitor EC1 is provided to the second source line CH2 (operation C1). Further, a part of the charge of the first source line CH1 is provided to the second external capacitor EC2 (operation C2).

The above operations C1 and C2 correspond to a section C of FIG. 9. In other words, when the second cross charge sharing switch SW_CCS2 is turned on, while the charge stored in the first external capacitor EC1 is provided to the second source line CH2, the voltage level of the first output terminal OUT1 decreases from Vcom to $V_{LX}$. At this time, the voltage level of the terminal QH decreases from $V_{UY}$ to $V_{UX}$ (see the dashed line displayed on the positive channel of FIG. 9).

On the other hand, when the second cross charge sharing switch SW_CCS2 is turned on, a part of the charge of the first source line CH1 is provided to the second external capacitor EC2, and thus, the voltage level of the second output terminal OUT2 increases from Vcom to $V_{UX}$. At this time, the voltage level of the terminal QL increases from $V_{LY}$ to $V_{LX}$ (see the dashed line displayed on the negative channel of FIG. 9).

In other words, in various embodiments of the present inventive concept, the section in which the cross charge sharing technique is executed corresponds to the section including sections A, B, and C of FIG. 9.

As the cross charge sharing technique is executed, the current required to be actively driven by the source driver 120 may be greatly reduced. The reason for this is that a substantial amount of the driving current of the display panel 200 due to the inversion of the polarity signal POL is processed by the charge sharing of three steps corresponding to the sections A, B, and C of FIG. 9.

In other words, when the source driver 120 is actively driven, it merely raises the voltage level of the positive channel, which reaches the $V_{UX}$ after execution of the cross charge sharing technique to $V_{UH}$. As a result, the amount of power expected to be consumed per unit cycle by the source driver 120 according to various embodiments of the present inventive concept is merely a hatched region PC of FIG. 9. As a result, heat generation due to the driving current may also be reliably reduced.

Figure 10:
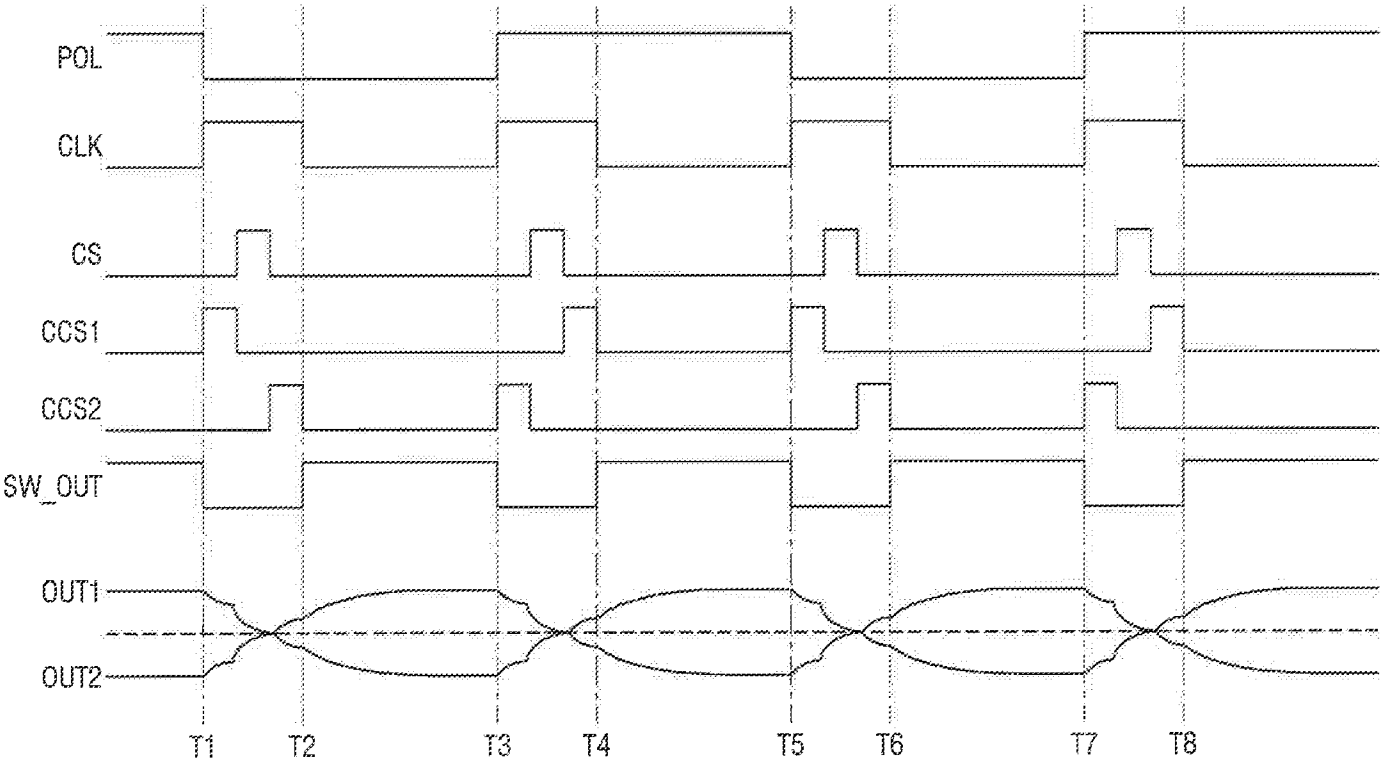
FIG. 10 is a timing chart illustrating the operation of a source driver according to an exemplary embodiment of the present inventive concept.

FIG. 10 is a timing chart illustrating the operation of a source driver according to an exemplary embodiment of the present inventive concept.

In the explanation of FIGS. 6 to 9, the turning-on sequence of the cross charge sharing technique is the first cross charge sharing switch SW_CCS1, the charge sharing switch SW_CS, and the second cross charge sharing switch CSS2. However, the present inventive concept is not limited thereto, and the turning-on sequence of the first cross charge sharing switch SW_CCS1 and the second cross charge sharing switch CSS2 may be changed depending on the polarity signal POL.

In other words, the turning-on sequence may be the second cross charge sharing switch SW_CSS2, the charge sharing switch SW_CS, and the first cross charge sharing switch SW_CCS1 depending on the polarity signal POL.

Referring to FIG. 10, a section in which the cross charge sharing technique is executed corresponds to the sections (T1 to T2, T3 to T4, T5 to T6, and 17 to 18).

In other words, in the sections (T1 to T2, and T5 to T6), the clock signal CLK is maintained at, for example, logic high and the output switch SW_OUT is turned off. Further, as described above for FIGS. 6 to 9, it is possible to know that signal transition occurs in the sequence of the first cross charge sharing switch control signal CCS1, the charge sharing switch control signal CS, and the second cross charge sharing switch control signal CCS2.

However, the sections (T3 to T4, and T7 to T8) having polarity signals POL of values different from those of the sections (T1 to T2, and T5 to T6) has the same configuration in which the clock signal CLK is maintained at, for example, logic high, and the output switch SW_OUT is turned off. However, unlike the configuration described above for FIGS. 6 to 9, it is possible to know that signal transition occurs in the sequence of the second cross charge sharing switch control signal CCS2, the charge sharing switch control signal CS and the first cross charge sharing switch control signal CCS1.

Figure 11:
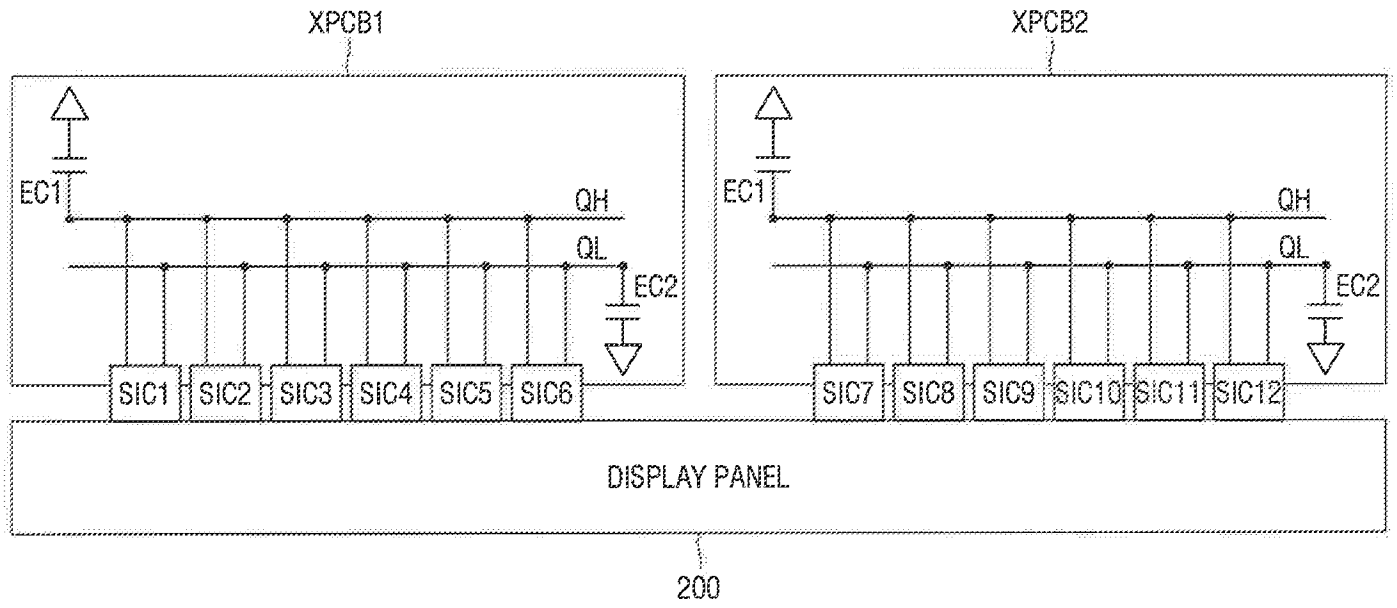
FIG. 11 is a diagram of a source driver according to an exemplary embodiment of the present inventive concept.

FIG. 11 is a diagram of a source driver according to an exemplary embodiment of the present inventive concept.

Referring to FIG. 11, when the resolution of the display panel 200 is very large, for example, 3840*2160 corresponding to an ultra high definition (UHD) panel, a plurality of source drivers (SIC1 and SIC12) corresponding to the source driver 120 described above may be implemented in a single display panel 200.

For example, the source drivers SIC to SIC6 may be implemented on the first PCB (XPCB1) to control a partial region of the display panel 200, and the source drivers (SIC7 to SIC12) may be implemented on the second PCB (XPCB2) to control another partial region of the display panel 200.

In particular, in the present embodiment, the source drivers (SIC1, SIC2, SIC3, SIC4, SIC5 and SIC6) on the first PCB (XPCB1) may use one capacitor EC1 and one capacitor EC2 with pre-determined capacitance in a shared manner. Further, the source drivers (SIC7, SIC8, SIC9, SIC10, SIC11 and SIC12) on the second PCB (XPCB2) may use one capacitor EC1 and one capacitor EC2 with pre-determined capacitance in a shared manner.

For example, when the capacitor load for each channel of the UHD panel is 300 pF, when adding up the loads of even-numbered channels, the above capacitance may be calculated as ((3480*3)/2)*300 pF=1.728 uF. Therefore, the capacitances of each of the capacitors EC1 and EC2 may be 4.7 uF. However, such a method of determining the capacitance is merely an example, and the capacitance of each of the capacitors EC1 and EC2 may be variously changed depending on a particular implementation.

Figure 12:
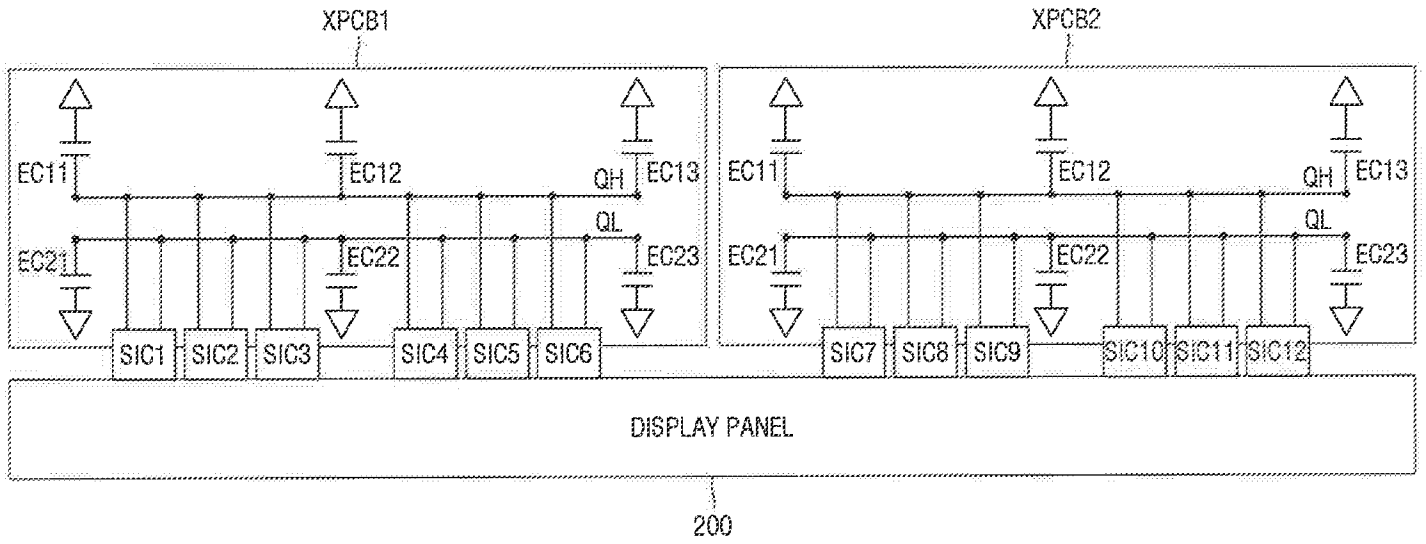
FIG. 12 is a diagram of a source driver according to an exemplary embodiment of the present inventive concept.

FIG. 12 is a diagram of a source driver according to an exemplary embodiment of the present inventive concept.

Referring to FIG. 12, as in the case of FIG. 11, when the resolution of the display panel 200 is very large, such as 3840*2160 corresponding to the UHD panel, a plurality of source drivers (SIC1 to SIC12) corresponding to the above-described source driver 120 may be implemented on a single display panel.

However, this embodiment is different from the embodiment of FIG. 11 in that the source drivers (SIC1 to SIC6) on the first PCB (XPCB1) use three capacitors (EC11, EC12 and EC13) and the three capacitors (EC21, EC22 and EC23) with pre-determined capacitances in a shared manner. Further, the source drivers (SIC7 to SIC12) on the second PCB (XPCB2) also use three capacitors (EC11, EC12 and EC13) and three capacitors (EC21, EC22 and EC23) with pre-determined capacitances in a shared manner. By using the dispersed external capacitors in this way, more increased display performance can be provided.

For example, when the capacitor load for each channel of the UHD panel is 300 pF, when adding up the loads of the even-numbered channels, the capacitance may be calculated as ((3480)*3)/2)*300 pF=1.728. Therefore, the capacitances of each of the capacitors (EC11, EC12, EC13, EC21, EC22 and EC23) may be 2.2 uF. However, such a method of determining the capacitance is merely an example, and the capacitances of each of the capacitors (EC11, EC12, EC13, EC21, EC22 and EC23) may be variously changed depending on a particular implementation.

Figure 13:
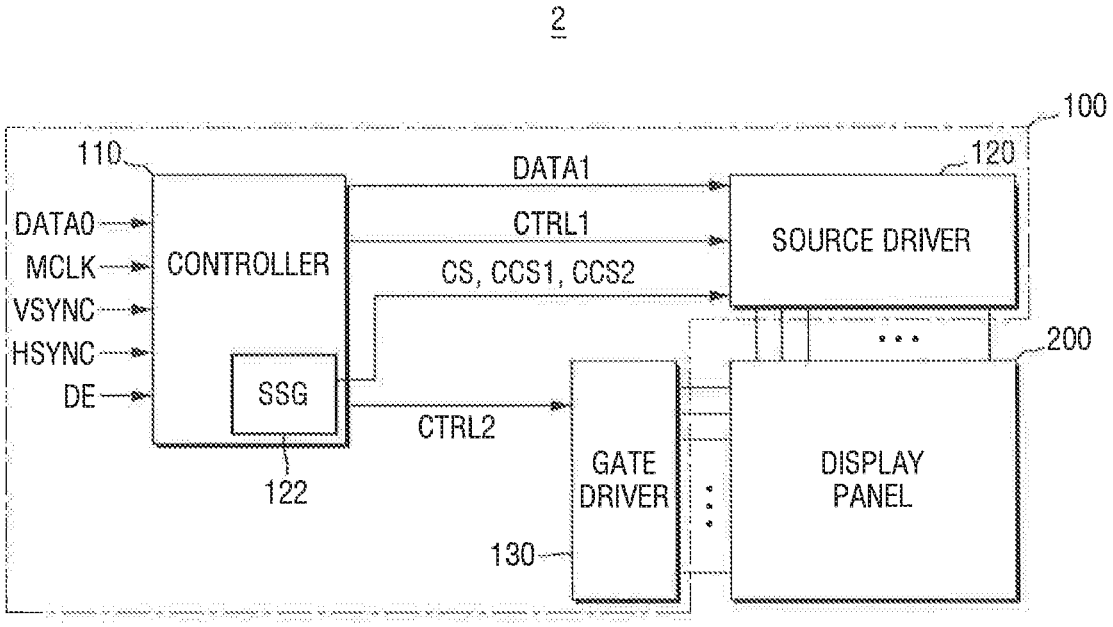
FIG. 13 is a block diagram of a display device according to an exemplary embodiment of the present inventive concept.

FIG. 13 is a block diagram of a display device according to an exemplary embodiment of the present inventive concept.

Referring to FIG. 13, this embodiment is different from the embodiment of FIGS. 1 and 2 in that the switching signal generator 122 is implemented on the controller 110 outside the source driver 120. For example, SSG 122 is shown in the controller 110.

In other words, the source driver 120 may be provided with the charge sharing switch control signal CS, the first cross charge sharing switch control signal CCS1, and the second cross charge sharing switch control signal CCS2 which control the operations of each of the charge sharing switch SW_CS, the first cross charge sharing switch SW_CCS1 and the second cross charge sharing switch SW_CCS2 from the switching signal generator 122 implemented on the controller 110.

Figure 14:
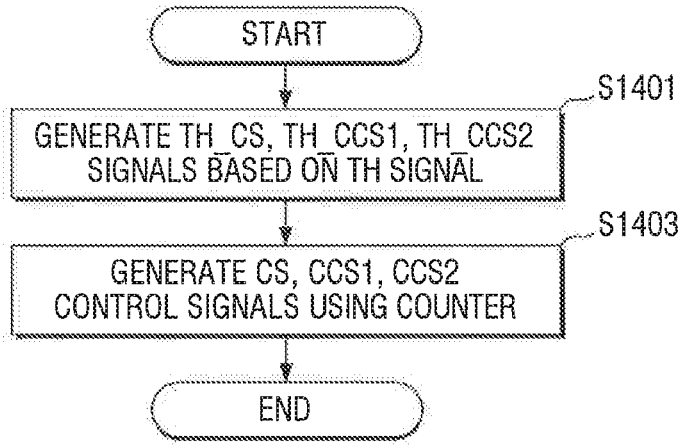
FIG. 14 is a flowchart illustrating a method of operating a source driver according to an exemplary embodiment of the present inventive concept.

FIG. 14 is a flowchart illustrating a method of operating a source driver according to an exemplary embodiment of the present inventive concept.

Referring to FIG. 14, the method of operating the source driver according to the present embodiment includes generating (S1401) a first horizontal synchronization period signal TH_CS, a second horizontal synchronization period signal TH_CCS1, and a third horizontal synchronization period signal TH_CCS2, in response to the horizontal synchronization period signal TH as described above.

Further, the method includes generating (S1403) the charge sharing switch control signal CS, the first cross charge sharing switch control signal CCS1 and the second cross charge sharing switch control signal CCS2, in response to the polarity signal POL, using the counter 1224 as described above referring to FIG. 4.

Figure 15:
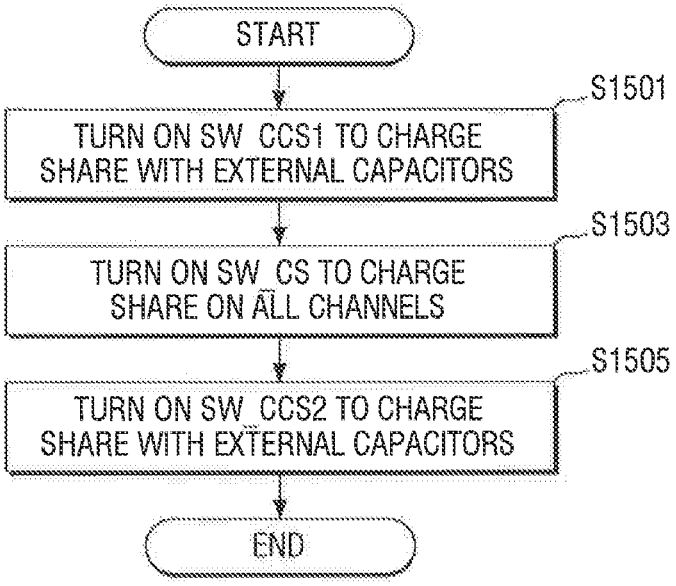
FIG. 15 is a flowchart illustrating a method of operating a source driver according to an exemplary embodiment of the present inventive concept.

FIG. 15 is a flowchart illustrating a method of operating a source driver according to an exemplary embodiment of the present inventive concept.

Referring to FIG. 15, the method of operating the source driver according to the present embodiment includes execution (S1501) of first charge sharing which turns on the first cross charge sharing switch SW_CCS1, provides a part of the charge of the first source line CH1 to the first external capacitor EC1, and provides the charge stored in the second external capacitor EC2 to the second source line CH2.

Further, the method includes execution (S1503) of the second charge sharing which turns on the charge sharing switch SW_CS and shares the charges of the first source line CH1 and the second source line CH2.

Further, the method includes execution (S1505) of the third charge sharing which turns on the second cross charge sharing switch SW_CCS2, provides the charge stored in the first external capacitor EC1 to the second source line CH2, and provides a part of the charge of the first source line CH1 to the second external capacitor EC2.

In exemplary embodiments of the present inventive concept, turning-on of the first cross charge sharing switch SW. CCS1 may further include providing of a part of the charge of the third source line CH3 to the first external capacitor EC1, and providing of the charge stored in the second external capacitor EC2 to the fourth source line CH4.

In addition, in exemplary embodiments of the present inventive concept, turning-on of the second cross charge sharing switch SW_CCS2 may further include providing of the charge stored in the first external capacitor EC1 to the fourth source line CH4, and providing of a part of the charge of the third source line CH3 to the second external capacitor EC2.

According to the source driver, the display driver IC circuit and the operation method thereof according to the exemplary embodiments of the present inventive concept described above, the power consumption and heat generation thereof can be greatly reduced.

As the above-described cross charge sharing technique is executed, a considerable amount of the driving current of the display panel 200 due to the inversion of the polarity signal POL is processed by charge sharing of three steps corresponding to the sections A, B and C of FIG. 9. Accordingly, the current required to be actively driven by the source driver 120 can be greatly reduced, and the heat generation due to the driving current can also be reliably reduced.

While the present inventive concept has been particularly illustrated and described with reference to exemplary embodiments thereof, it will be understood by those of ordinary skill in the art that various changes in form and detail may be made therein without departing from the spirit and scope of the present inventive concept as defined by the following claims.

What is claimed is:

1. A source driver, comprising:

a first source line connected to a first terminal;

a second source line connected to a second terminal;

a charge sharing switch which controls a connection between the first source line and the second source line;

a first cross charge sharing switch which controls a connection between a first capacitor and the first source line, and a connection between a second capacitor and the second source line, wherein a first cross charge sharing line is connected to a first end of the first cross charge sharing switch, a second end of the first cross charge sharing switch is connected to the first source line, and the first capacitor is connected to the first cross charge sharing line though a third terminal; and a second cross charge sharing switch which controls a connection between the first capacitor and the second source line, and a connection between the second capacitor and the first source line.

2. The source driver of claim 1, wherein, while the first cross charge sharing switch is turned on, the charge sharing switch and the second cross charge sharing switch are turned off, and while the second cross charge sharing switch is turned on, the charge sharing switch and the first cross charge sharing switch, are turned off.

3. The source driver of claim 2, wherein, when the first cross charge sharing switch is turned on, a part of a charge of the first source line is provided to the first capacitor, and a charge stored in the second capacitor is provided to the second source line.

4. The source driver of claim 2, wherein, when the second cross charge sharing switch is turned on, a charge stored in the first capacitor is provided to the second source line, and a part of a charge of the first source line is provided to the second capacitor.

5. The source driver of claim 1, wherein, while the charge sharing switch is turned on, the first cross charge sharing switch and the second cross charge sharing switch are turned off, and charges of the first source line and the second source line are shared with each other.

6. The source driver of claim 1, further comprising:

an output switch which controls a connection between the first source line and a first buffer, and a connection between the second source line and a second buffer, wherein, while the output switch is turned off, one of the first cross charge sharing switch and the second cross charge sharing switch is first turned on, the charge sharing switch is second turned on, and the other one of the first cross charge sharing switch and the second cross charge sharing switch is third turned on.

7. The source driver of claim 6, wherein a sequence of turning-on the first cross charge sharing switch and the second cross charge sharing switch depends on a polarity signal.

8. A display driver integrated circuit (IC), comprising:

a source driver which drives a data line of a display panel;

a gate driver which drives a gate line of the display panel; and a controller which controls the source driver and the gate driver, wherein the source driver includes a first capacitor, a second capacitor and a channel buffer, and the channel buffer includes:

a first source line;

a second source line;

a charge sharing switch which controls a connection between the first source line and the second source line;

a first cross charge sharing switch which controls a connection between the first capacitor and the first source line, and a connection between the second capacitor and the second source line, wherein the first capacitor is connected to a first cross charge sharing line through a first terminal and the second capacitor is connected to a second cross charge sharing line through a second terminal; and a second cross charge sharing switch which controls a connection between the first capacitor and the second source line, and a connection between the second capacitor and the first source line.

9. The display driver IC of claim 8, wherein, while the first cross charge sharing switch is turned on, the charge sharing switch and the second cross charge sharing switch are turned off, and while the second cross charge sharing switch is turned on, the charge sharing switch and the first cross charge sharing switch are turned off.

10. The display driver C of claim 9, wherein, when the first cross charge sharing switch is turned on, a part of a charge of the first source line is provided to the first capacitor, and a charge stored in the second capacitor is provided to the second source line.

11. The display driver IC of claim 9, wherein, when the second cross charge sharing switch is turned on, a charge stored in the first capacitor is provided to the second source line, and a part of a charge of the first source line is provided to the second capacitor.

12. The display driver IC of claim 8, wherein the channel buffer includes a first buffer, a second buffer, and an output switch, the output switch controlling a connection between the first source line and the first buffer and a connection between the second source line and the second buffer, wherein, while the output switch is turned off, one of the first cross charge sharing switch and the second cross charge sharing switch is first turned on, the charge sharing switch is second turned on, and the other one of the first cross charge sharing switch and the second cross charge sharing switch is third turned on.

13. The display driver 1C of claim 12, wherein a sequence of turning-on the first cross charge sharing switch and the second cross charge sharing switch depends on a polarity signal.

14. A source driver, comprising:

a first source line connected to a first terminal, a second source line connected to a second terminal, a third source line connected to a third terminal and a fourth source line connected to a fourth terminal;

a plurality of charge sharing switches which control connections of the first source line, the second source line, the third source line and the fourth source line to each other;

a plurality of first cross charge sharing switches which control connections between a first capacitor, the first source line and the third source line, and connections bet wen a second capacitor, the second source line and the fourth source line, wherein the first capacitor is connected to a first cross charge sharing line through a fifth terminal and the second capacitor is connected to a second cross charge sharing line through a sixth terminal; and a plurality of second cross charge sharing switches which control connections between the first capacitor, the second source line and the fourth source line, and connections between the second capacitor, the first source line and the third source line.

15. The source driver of claim 14, wherein, while the plurality of first cross charge sharing switches are turned on, the plurality of charge sharing switches and the plurality of second cross, charge sharing switches are turned off, and while the plurality of second cross charge sharing switches are turned on, the plurality of charge sharing switches and the plurality of first cross charge sharing switches are turned off.

16. The source driver of claim 15, wherein, when the plurality of first cross charge sharing switches are turned on, a part of a charge of the first source line and the third source line is provided to the first capacitor, and a charge stored in the second capacitor is provided to the second source line and the fourth source line.

17. The source driver of claim 15, wherein, when the plurality of second cross charge sharing switches are turned on, a charge stored in the first capacitor is provided to the second source line and the fourth source line, and a part of a charge of the first source line and the third source line is provided to the second capacitor.

18. The source driver of claim 14, wherein, while the plurality of charge sharing switches are turned on, the plurality of first cross charge sharing switches and the plurality of second cross charge sharing switches are turned off, charges of the first source line and the second source line are shared with each other, and charges of the third source line and the fourth source line are shared with each other.

19. The source driver of claim 14, further comprising:

a plurality of output switches which control connections between the first source line, the second source line, the third source line and the fourth source line and a first buffer, a second buffer, a third buffer and a fourth buffer, respectively, wherein, while the plurality of output switches are turned off, one of the plurality of first cross charge sharing switches and the plurality of second cross charge sharing switches are first turned on, the plurality of charge sharing switches are second turned on, and the other one of the plurality of first cross charge sharing switches and the plurality of second cross charge sharing switches are third turned on.

20. The source driver of claim 19, wherein an order of turning-on the plurality of first cross charge sharing switches and the plurality of second cross charge sharing switches depends on a polarity signal.

* * * * *